US009918608B2

(12) United States Patent
Ryu et al.

(10) Patent No.: US 9,918,608 B2
(45) Date of Patent: Mar. 20, 2018

(54) DISH WASHER

(71) Applicant: Samsung Electronics Co., Ltd., Suwon-si (KR)

(72) Inventors: Jung Chan Ryu, Suwon-si (KR); Seung Gee Hong, Suwon-si (KR); Sung Jin Kim, Suwon-si (KR)

(73) Assignee: SAMSUNG ELECTRONICS CO., LTD., Suwon (KR)

( * ) Notice: Subject to any disclaimer, the term of this patent is extended or adjusted under 35 U.S.C. 154(b) by 121 days.

(21) Appl. No.: 14/027,751

(22) Filed: Sep. 16, 2013

(65) Prior Publication Data

US 2014/0130833 A1 May 15, 2014

(30) Foreign Application Priority Data

Nov. 12, 2012 (KR) ..... 10-2012-0127662

(51) Int. Cl.
*A47L 15/18* (2006.01)
*A47L 15/22* (2006.01)
*A47L 15/42* (2006.01)

(52) U.S. Cl.
CPC ..... *A47L 15/18* (2013.01); *A47L 15/22* (2013.01); *A47L 15/4221* (2013.01);
(Continued)

(58) Field of Classification Search
CPC .... B08B 1/04; B08B 5/02; B08B 5/04; B08B 3/00; B08B 3/02; B08B 3/04;
(Continued)

(56) References Cited

U.S. PATENT DOCUMENTS 3,447,752 A * 6/1969 Hardy ..... 239/251
5,464,482 A * 11/1995 Michael ..... A47L 15/22 134/172

(Continued)

FOREIGN PATENT DOCUMENTS

| | | |
|---|---|---|
| DE | 1946835 | 3/1970 |
| DE | 29607515 | 8/1997 |
| KR | 10-2006-0013790 | 2/2006 |

OTHER PUBLICATIONS

Extended European Search Report dated Jan. 31, 2014 in European Patent Application No. 13188463.7.

(Continued)

*Primary Examiner* — Michael E Barr
*Assistant Examiner* — Tinsae B Ayalew
(74) *Attorney, Agent, or Firm* — Staas & Halsey LLP

(57) ABSTRACT

A dish washer is provided to improve washing efficiency by washing dishware having severe degree of contamination in a concentrated manner through an auxiliary spraying nozzle, and which is also easily setting a concentrated wash zone as a user varies a position of the auxiliary spraying nozzle. The dish washer may include a main spraying nozzle which sprays wash water to dishware baskets, a connecting path to connect a sump unit to the main spraying nozzle, an auxiliary spraying nozzle to receive wash water from the sump unit and spray wash water to dishware baskets, and an auxiliary path to connect the sump unit to the auxiliary spraying nozzle. A spraying position of wash water supplied from the auxiliary spraying nozzle is varied by rotation of the auxiliary path, thereby washing dishware having severe degree of contamination in a concentrated manner.

13 Claims, 7 Drawing Sheets

(52) U.S. Cl.
CPC ..... *A47L 15/4282* (2013.01); *A47L 2401/04* (2013.01); *A47L 2501/20* (2013.01)

(58) Field of Classification Search
CPC ..... B08B 3/024; A47L 15/16; A47L 15/18; A47L 15/4221; A47L 15/4257; A47L 15/428; A47L 15/502
USPC ... 134/25.2, 135, 18, 184, 200, 25.1, 33, 34, 134/56 D, 94.1, 99.1
See application file for complete search history.

(56) References Cited

U.S. PATENT DOCUMENTS

| | | | | |
|---|---|---|---|---|
| 2010/0116296 | A1* | 5/2010 | Bertsch et al. | 134/25.2 |
| 2011/0088239 | A1* | 4/2011 | Hennemann et al. | 29/428 |
| 2011/0214702 | A1* | 9/2011 | Brown-West et al. | 134/198 |

OTHER PUBLICATIONS

European Communication dated Aug. 1, 2016 in European Patent Application No. 13188463.7.

* cited by examiner

DISH WASHER

CROSS-REFERENCE TO RELATED APPLICATIONS

This application claims the priority benefit of the Korean Patent Application No. 10-2012-0127662, filed on Nov. 12, 2012, in the Korean Intellectual Property Office, the disclosure of which is incorporated herein by reference.

BACKGROUND

1. Field

Embodiments of the present disclosure relate to a dish washer.

2. Description of the Related Art

In general, a dish washer includes a body having a washing tub, a dishware basket provided at an inside the washing tub, a spraying nozzle configured to spray wash water to the dishware basket, and a sump unit connected to the spraying nozzle to pump wash water to the spraying nozzle.

A sump unit included in a conventional dish washer includes an impeller, a path configured to guide wash water to a spraying nozzle while connected to the impeller, a dirt chamber configured to collect dirt mixed in the wash water while connected to some path, a drain pump connected to the dirt chamber, and a filter cover covering the dirt chamber and provided with a filter configured to perform a separation filtering on the wash water and the dirt introduced to the dirt chamber.

The spraying nozzle connected to the sump unit includes a lower portion spraying nozzle, a mid portion spraying nozzle, and an upper portion spraying nozzle. The spraying nozzle is provided so as to be rotatable by a rotor. A dishware placed at one point in the conventional dishware basket is supplied with wash water only when the spraying nozzle passes through the one point at which the dishware is placed while the rotor is rotating. In the case as such, a dishware having severe degree of contamination and a dishware having relatively less degree of contamination are not being washed in a differentiated manner, and thus washing efficiency of the dishware is not superior.

SUMMARY

In an aspect of one or more embodiments, there is provided a dish washer capable of washing dishware having severe degree of contamination in a concentrated manner by the wash water sprayed through an auxiliary spraying nozzle. The position of the auxiliary spraying nozzle may be varied by the convenience of a user.

In accordance an aspect of one or more embodiments, there is provided a dishwasher which includes a body, a door, a plurality of dishware baskets, a sump unit, a main spraying nozzle, a connection path, an auxiliary spraying nozzle, and an auxiliary path. The body may have a washing tub formed therein. The door may be configured to open/close one surface of the body. The plurality of dishware baskets may be provided at an inside the washing tub. The sump unit may be provided at an inside the washing tub and configured to accommodate and supply wash water. The main spraying nozzle may be configured to receive the wash water from the sump unit and spray the wash water to the plurality of dishware baskets. The connecting path may be configured to connect the sump unit to the main spraying nozzle. The auxiliary spraying nozzle may be configured to receive the wash water from the sump unit and spray the wash water to the plurality of dishware baskets. The auxiliary path may be configured to connect the sump unit to the auxiliary spraying nozzle. A spraying position of the wash water being supplied from the auxiliary spraying nozzle may be varied by rotation of the auxiliary path, thereby washing dishware having severe degree of contamination in a concentrated manner.

The auxiliary path may include a first auxiliary path and a second auxiliary path, and the second auxiliary path may be rotatably connected to the first auxiliary path.

The second auxiliary path may be communicated with the first auxiliary path.

The second auxiliary path may be connected to the first auxiliary path by a connecting unit that is foldable or unfoldable.

The second auxiliary path may be rotatable in both directions by a motor.

A manipulation unit may be further provided at the body, and the second auxiliary path may be rotated through a manipulation of the manipulation unit.

The manipulation unit may be provided in a form of a plurality of buttons or dials, and the second auxiliary path may be configured to be rotated in a predetermined rotating direction or at a predetermined rotating angle according to the manipulation of the manipulation unit.

The second auxiliary path may be rotated while dishware is being washed, so that the wash water being sprayed by the auxiliary spraying nozzle washes the dishware provided at an inside the washing tub in a concentrated manner.

A valve configured to open/close the connecting path or the auxiliary path may be provided at the sump unit.

In accordance with an aspect of one or more embodiments, there is provided a dish washer which includes a sump unit, a main spraying nozzle, a connecting path, an auxiliary spraying nozzle, and an auxiliary path. The sump unit may be configured to accommodate wash water. The main spraying nozzle may be configured to spray wash water being supplied from the sump unit. The connecting path may be configured to connect the sump unit to the main spraying nozzle. The auxiliary spraying nozzle may be configured to spray the wash water being supplied from the sump unit to a position that is needed to be washed in a concentrated manner. The auxiliary path may be configured to connect the sump unit to the auxiliary spraying nozzle. The auxiliary path may include a first auxiliary path connected to the sump unit and a second auxiliary path configured to move relative to the first auxiliary path so as to vary a position of the auxiliary spraying nozzle.

A portion of the second auxiliary path may be provided to extend from the first auxiliary path while being inserted into the first auxiliary path.

A plurality of protrusions may be formed at an inner side of the first auxiliary path, and the second auxiliary path may be provided at one side thereof with a locking unit being interfered with the protrusions, so that the second auxiliary path is fixed as the locking unit is interfered with the protrusion.

The plurality of protrusions may be formed along a moving direction of the locking unit of when the second auxiliary path is being extended.

The first auxiliary path may be provided to form a shape of a curve, and at least a portion of the second auxiliary path being inserted into the first auxiliary path may be provided to correspond to the shape of the first auxiliary path.

The auxiliary spraying nozzle may be provided in a plurality thereof, and at least one of the plurality of auxiliary spraying nozzles may be varied in position.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
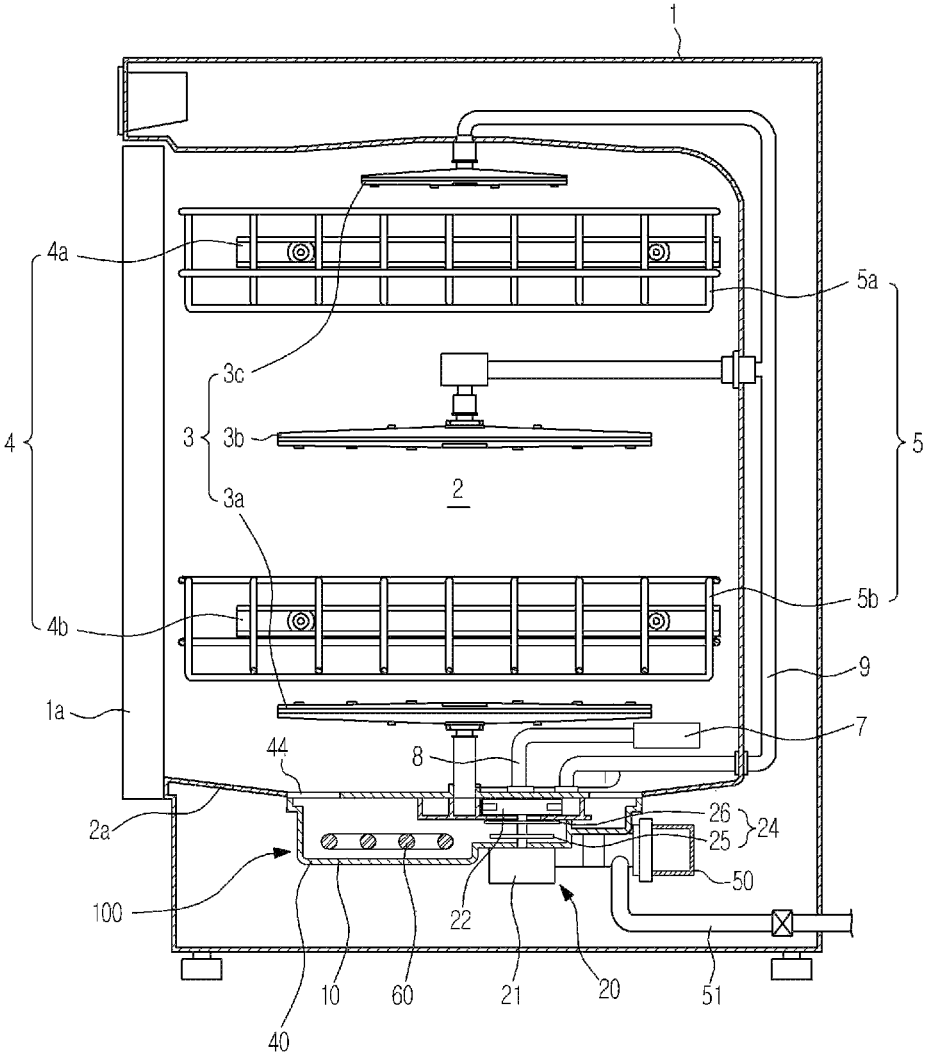
FIG. 1 is a side cross-sectional view of a dish washer in accordance with an embodiment.

Reference will now be made in detail to embodiments, examples of which are illustrated in the accompanying drawings, wherein like reference numerals refer to like elements throughout.

Figure 2:
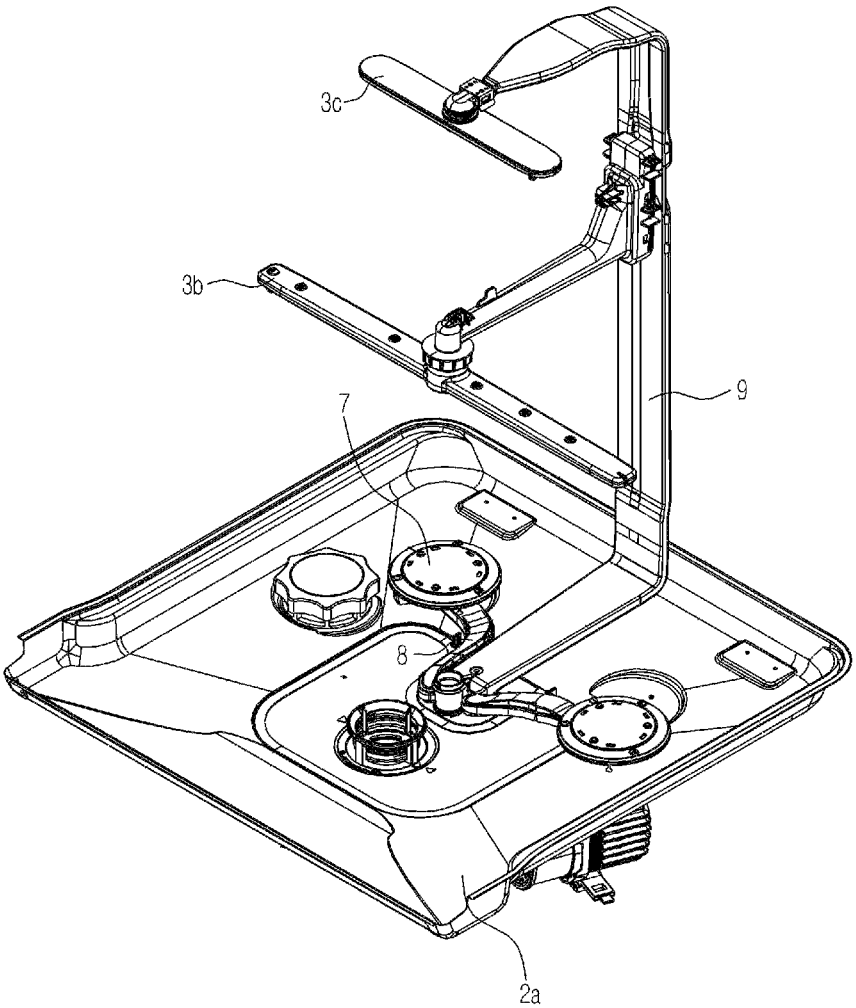
FIG. 2 is a perspective view showing an inside the dish washer in accordance with an embodiment.
Figure 3:
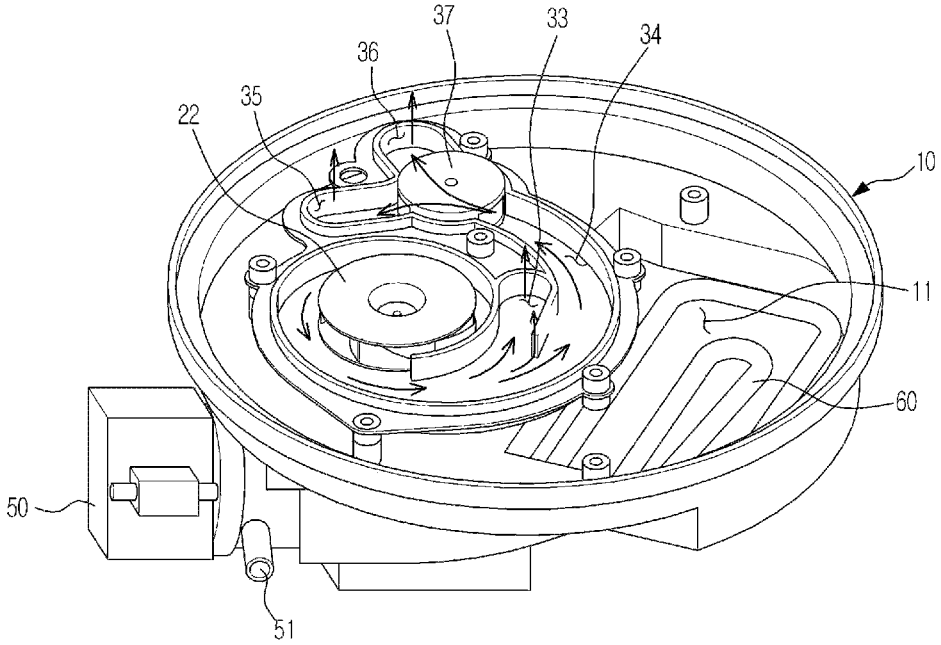
FIG. 3 is a drawing illustrating a view of an inside a sump in accordance with an embodiment.

FIG. 1 is a side cross-sectional view of a dish washer in accordance with an embodiment, FIG. 2 is a perspective view showing an inside the dish washer in accordance with an embodiment, and FIG. 3 is a drawing illustrating a view of an inside a sump in accordance with an embodiment.

Referring to FIGS. 1 to 3, the dish washer in accordance with an embodiment includes a body 1 and a door 1*a*. The body 1 includes a washing tub 2 in which dishware may be disposed and washed. One surface of the body 1 is open, and the door 1 a is rotatably coupled to the one surface of the body 1 to open/close the open one surface.

At a lower portion of the washing tub 2, a sump unit 100 may be provided. The sump unit 100 accommodates wash water, ad pumps the accommodated wash water. The wash water pumped by the sump unit 100 is sprayed to an inside the washing tub 2 through a main spraying nozzle 3 and an auxiliary spraying nozzle 7.

At the washing tub 2, a rack 4 is provided. The rack 4 includes an upper rack 4*a* disposed at an upper side of the washing tub 2, and a lower rack 4*b* disposed at a lower side of the washing tub 2, a dishware basket 5 at which dishware may be positioned may be mounted at the rack 4 in a sliding manner. The dishware basket 5 includes a first dishware basket 5*a* mounted at the upper rack 4*a* and a second dishware basket 5*b* mounted at the lower rack 4*b*.

At one side surface of the washing tub 2, a water supplying port (not shown) is provided, and the wash water being supplied through the water supplying port (not shown) drops to a bottom surface 2*a* of the washing tub 2. The wash water dropping to the bottom surface 2*a* of the washing tub 2 is introduced to an inside the sump unit 100 through an inlet 44 formed at a housing cover 40 of the sump unit 100.

The sump unit 100 accommodates and pumps wash water to supply the wash water to the main spraying nozzle 3 or to the auxiliary spraying nozzle 7. The sump unit 100 includes a sump housing 10 and a washing pump 20. The sump housing 10 forms an exterior appearance of the sump unit 100. The washing pump 20 may be mounted at one side of the sump housing 10.

At the sump housing 10, a heater 60 may be mounted. For example, the washing pump 20 is mounted at a portion of the sump housing 10 spaced apart from a central portion of the sump housing 10 in a radial direction, and the heater 60 may be mounted at a position opposite to the washing pump 20 with respect to a central portion of the sump housing 10. A heater installing groove (not shown) is formed at the sump housing 10 in a recessed manner, and the heater 60 may be accommodated in the heater installing groove (not shown).

The washing pump 20 includes a pump motor 21 and an impeller 22. The pump motor 21 may be fixedly installed at a lower surface of the sump housing 10. The pump motor 21 is installed at the lower surface of the sump housing 10, and a rotating shaft of the pump motor 21 may be protruded while penetrating through the lower surface of the sump housing 10. At this time, a sealing member (not shown) surrounding the rotating shaft is provided at the lower surface of the sump housing 10, so that the wash water may be prevented from being leaked toward the pump motor 21. The impeller 22 may be rotatably installed at the rotating shaft of the pump motor 21. The impeller 22 may discharge the wash water introduced in an axial direction of the rotating shaft to a radial direction of the rotating shaft.

In between the pump motor 21 and the impeller 22, a grinding device 24 may be provided. The grinding device 24 may include a cutter unit 25 configured to grind dirt such as food remnant introduced to the sump unit 100 into small masses while being coupled to the rotating shaft of the pump motor 21 so as to be rotated, and a dirt filter 26 provided at an upper portion of the cutter unit 25 to prevent a relatively large dirt from being introduced to the impeller 22. At the sump unit 100, a dirt chamber (not shown) is provided, and fine dirt that is passed through the dirt filter 26 may be collected at the dirt chamber (not shown).

A drain pump 50 and a drain pipe 51 may be connected to the dirt chamber (not shown). As the drain pump 50 is driven, the dirt that is collected at the dirt chamber (not shown) may be discharged along with the wash water toward the drain pipe 51 by the driving of the drain pump 50.

The main spraying nozzle 3 is provided so as to be rotated by a spraying pressure of the wash water being sprayed. The main spraying nozzle 3 may include a first main spraying nozzle 3*a* disposed in between the sump unit 100 and the lower rack 4*b*, a second main spraying nozzle 3*b* disposed in between the upper rack 4*a* and the lower rack 4*b*, and a third main spraying nozzle 3*c* disposed at an upper side of the upper rack 4*a*.

The first main spraying nozzle 3*a* is rotatably connected to an upper central portion of the sump unit 100. The first main spraying nozzle 3*a* sprays the wash water pumped from the sump unit 100 toward the second dishware basket 5*b* that is adjacent to the first main spraying nozzle 3*a*. The second main spraying nozzle 3*b* and the third main spraying nozzle 3*c* may be able to spray the wash water pumped from the sump unit 100 toward the first dishware basket 5*a* and the second dishware basket 5*b* that are adjacent to the second main spraying nozzle 3*b* and the third main spraying nozzle 3*c*.

The second main spraying nozzle 3*b* and the third main spraying nozzle 3*c* are connected to the sump unit 100 through an extension path 9. The extension path 9 may be extended along the rear surface of the washing tub 2. The wash water that is pumped from the sump unit 100 may be supplied to the second main spraying nozzle 3*b* and the third main spraying nozzle 3*c* through the extension path 9.

In general, the main spraying nozzle 3 sprays wash water while being rotated by the spraying pressure of the wash water that is being sprayed in a particular direction. The main spraying nozzle 3 sprays wash water to the entire area of the dishware basket 5 while rotating. In a case of the dishware placed at a particular zone of the dishware basket 5, the wash water is supplied to the dishware only when the main spraying nozzle 3 passes the corresponding zone while rotating. In addition, in order to reduce the amount of the water being used and increase the spraying pressure of the wash water, the first main spraying nozzle 3*a*, the second main spraying nozzle 3*b*, and the third main spraying nozzle 3*c* are controlled to alternately spray wash water according to a predetermined control method without simultaneously spraying wash water. Thus, dishware that is placed at a particular zone does not continuously receive wash water, and may only be able to receive wash water only when a nearby one of the main spraying nozzles 3*a*, 3*b* and 3*c* sprays wash water and the nearby main spraying nozzle passes the particular zone while rotating.

At a lower side of the washing tub 2, the auxiliary spraying nozzle 7 may be provided. The auxiliary spraying nozzle 7 may be able to spray wash water at a zone at which a strong wash is needed to wash the dishware having severe degree of contamination. A user may position the auxiliary spraying nozzle 7 such that the wash water may be sprayed at the zone at which the dishware having severe degree of contamination is located.

The auxiliary spraying nozzle 7 may discharge wash water, so that the wash water may be able to reach the blind zone at which the wash water being sprayed from the main spraying nozzle 3 may not be able to reach. As above, even the dishware positioned at the blind zone at which the wash water being sprayed from the main spraying nozzle 3 may not be able to reach may be able to be washed in a clean manner by the wash water being sprayed from the auxiliary spraying nozzle 7.

At the sump unit 100, a path unit may be formed. At the sump unit 100, the impeller 22 is mounted, and the path unit may be formed in the shape of a spiral with respect to the impeller 22.

As one example, the path unit includes a first path unit 33 and a second path unit 34. The first path unit 33 may be able to guide wash water to the first main spraying nozzle 3*a*. The first path unit 33 may be directly supply the wash water being discharged from the impeller 22 to the first main spraying nozzle 3*a* without a separate path member.

The second path unit 34 is divided into a first dividing path unit 35 and a second dividing path unit 36. The first dividing path unit 35 is connected to an auxiliary path 8. The second dividing path unit 36 is connected to the extension path 9. A valve 37 is rotatably installed at the second path unit 34. The valve 37 may be able to open/close the first dividing path unit 35 or the second dividing path unit 36. The valve 37 may be able to selectively open/close the first dividing path unit 35 or the second dividing path unit 36, or may be provided in a way to open/close the first dividing path unit 35 and the second dividing path unit 36 together.

For example, in a case when dishware that is needed to be washed in a concentrated manner is present, the valve 37 may close the first dividing path unit 35 and open the second dividing path unit 36 to supply wash water to the extension path 9. The wash water supplied to the extension path 9 may be able to wash the dishware while being sprayed through the auxiliary spraying nozzle 7. In a case when dishware that is needed to be washed in a concentrated manner is not present, the valve 37 may open the first dividing path unit 35 and close the second dividing path unit 36. As the first dividing path unit 35 is open, the wash water is supplied to the auxiliary path 8 by flowing to the first dividing path unit 35. The wash water supplied to the auxiliary path 8 may be able to wash a dishware while being sprayed through the second main spraying nozzle 3*b* and the third main spraying nozzle 3*c*.

From the above, the descriptions are provided that the path at an inside the sump unit 100 is divided into the first path unit 33 and the second path unit 34, the second path unit 34 is divided into the first dividing path unit 35 and the second dividing path unit 36, and the valve 37 is installed at the second path unit 34 to open/close the first dividing path unit 35 and the second dividing path unit 36. However, the path may be divided into the first path unit 33, the first dividing path unit 35 and the second dividing path unit 36, and by the valve 37, the first path unit 33, the first dividing path unit 35, and the second dividing path unit 36 may be open/closed. Depending on the shape of the path unit and the control method of the valve 37, wash water may be alternately sprayed through the first main spraying nozzle 3*a*, the second main spraying nozzle 3*b*, the third main spraying nozzle 3*c*, and the auxiliary spraying nozzle 7.

Figure 4:
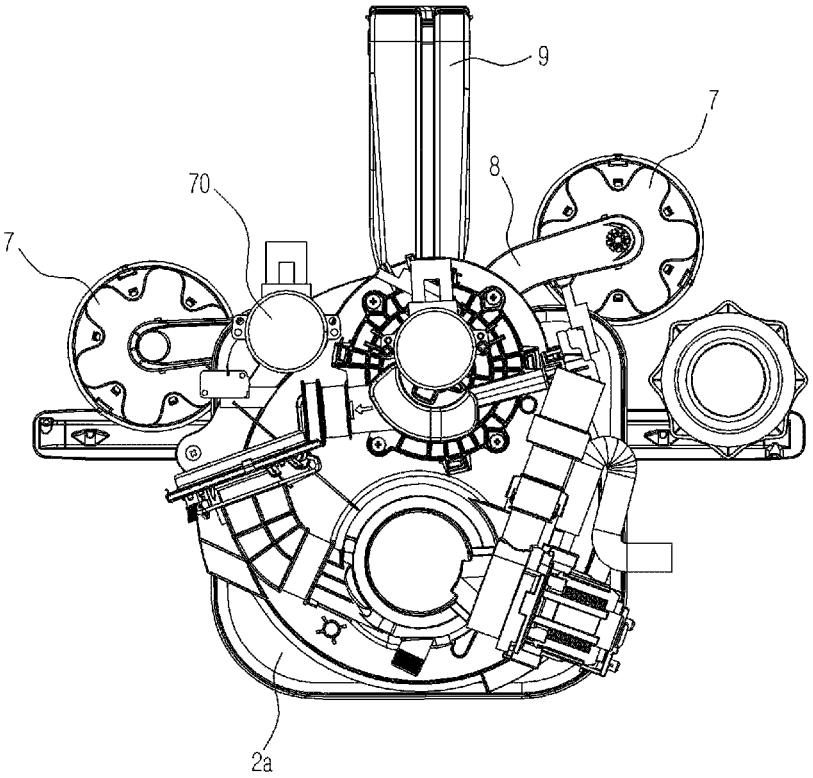
FIG. 4 is a drawing illustrating a back surface of an auxiliary spraying nozzle coupling unit of the dish washer in accordance with an embodiment.
Figure 5:
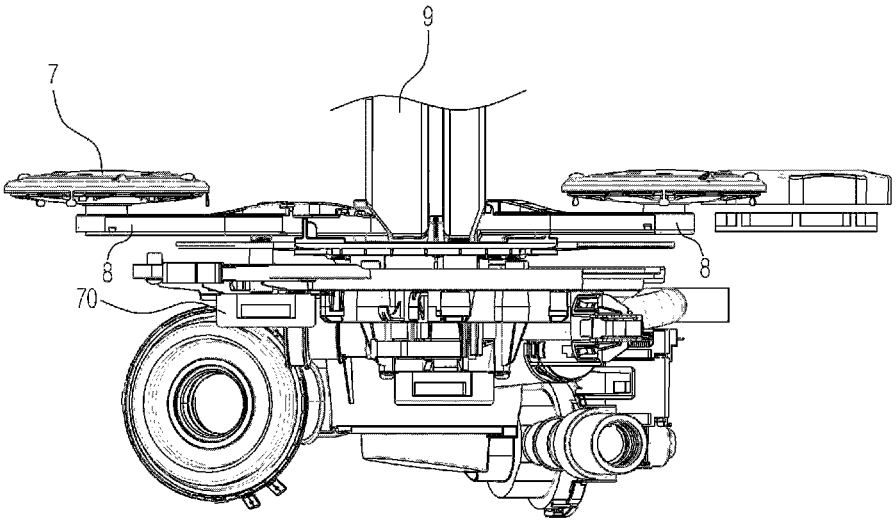
FIG. 5 is a drawing illustrating a side view of the auxiliary spraying nozzle coupling unit of the dish washer in accordance with an embodiment.
Figure 6:
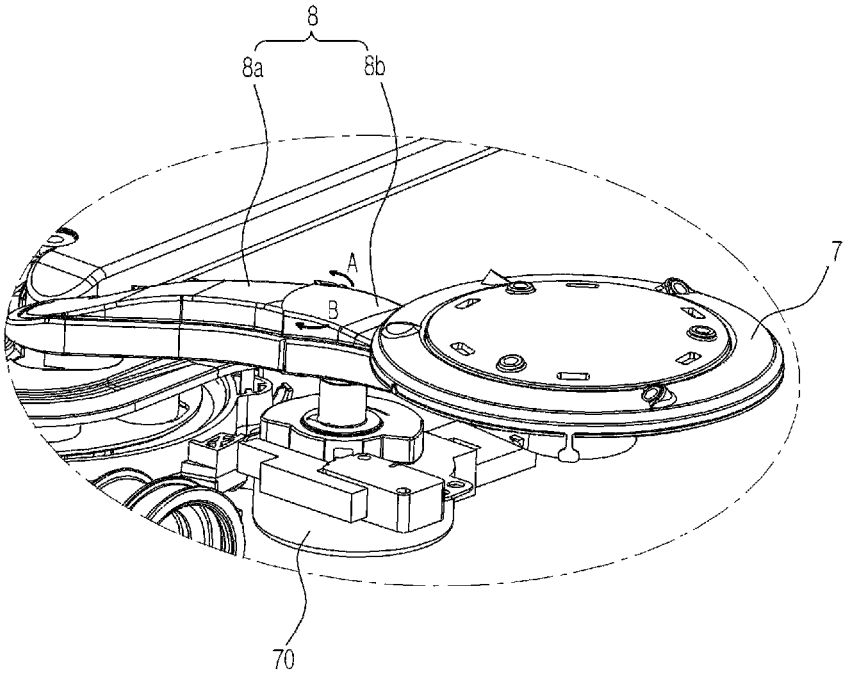
FIG. 6 is a drawing illustrating a view of an auxiliary spraying nozzle of the dish washer in accordance with an embodiment.
Figure 7:
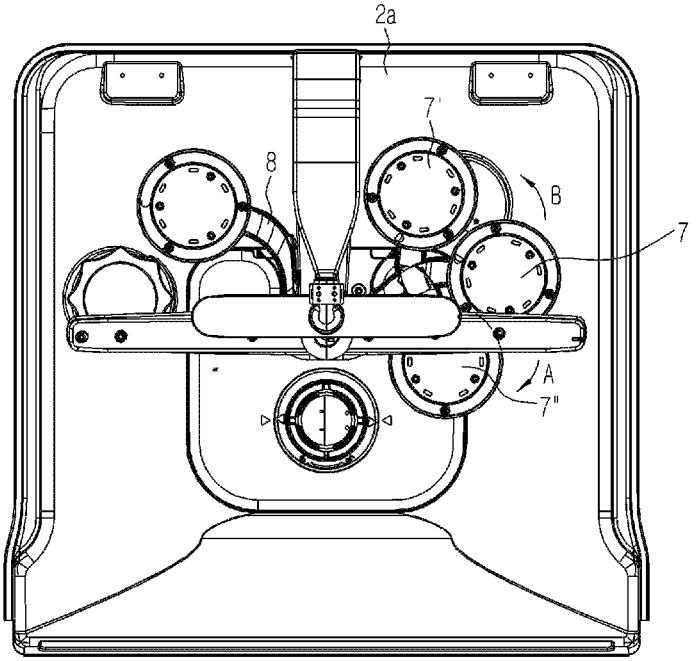
FIG. 7 is a drawing illustrating a motion of the auxiliary spraying nozzle of the dish washer in accordance with an embodiment.

FIG. 4 is a drawing illustrating a back surface of an auxiliary spraying nozzle coupling unit of the dish washer in accordance with an embodiment, FIG. 5 is a drawing illustrating a side view of the auxiliary spraying nozzle coupling unit of the dish washer in accordance with an embodiment, FIG. 6 is a drawing illustrating a view of the auxiliary spraying nozzle of the dish washer in accordance with an embodiment, and FIG. 7 is a drawing illustrating an operation of the auxiliary spraying nozzle of the dish washer in accordance with an embodiment.

Referring to FIGS. 4 to 7, the auxiliary spraying nozzle 7 in accordance with an embodiment may be rotatably installed. The auxiliary path 8 connecting the auxiliary spraying nozzle 7 to the sump unit 100 includes a first auxiliary path 8*a* and a second auxiliary path 8*b*. The first auxiliary path 8*a* and the second auxiliary path 8*b* may be provided in a way to communicate with each other. The second auxiliary path 8*b* may be rotatably connected to the first auxiliary path 8*a* in a state of being communicated with the first auxiliary path 8*a*. That is, the first auxiliary path 8*a* and the second auxiliary path 8*b* may be pivotedly coupled to each other. For example, a connecting unit is formed of soft material so as to be folded or unfolded, and the second auxiliary path 8*b* may be rotated in a direction 'A' or a direction 'B' while having the connecting unit as a center of rotation. The structure of the connecting unit is not limited to the description above.

The second auxiliary path 8*b* may be rotated by a motor 70. The motor 70 capable of rotating the second auxiliary path 8*b* may be mounted at the auxiliary path 8. The motor 70 may be able to rotate the second auxiliary path 8*b* in both directions. At a rotating shaft of the motor 70 connected to the second auxiliary path 8*b* is provided with a rib structure in multi stages, and by the rib, the second auxiliary path 8*b* may be able to stop after being rotated at a certain angle by the motor 70.

A user, by manipulating a manipulation unit, may be able to rotate the second auxiliary path 8*b*, so that the auxiliary spraying nozzle 7 may be placed at the zone that is needed to be provided with a concentrated wash. As one example, a rotating direction or a rotating angle of the auxiliary path 8*b* may be predetermined, and a user may be able to position the auxiliary spraying nozzle 7 at a desired portion through the manipulation of the manipulation unit. A structure such as a plurality of buttons or a plurality of dials having different rotating directions or rotating angles of the second auxiliary path 8*b* may be provided at the manipulation unit, and a user, by manipulating the buttons or the dials above, may rotate the second auxiliary path 8*b* toward a predetermined rotating direction or toward a predetermined rotating angle, so that the auxiliary spraying nozzle 7 may be able to spray wash water at the position at which a concentrated wash is needed.

In addition, during the course of the dish washer washing dishware, as for the auxiliary spraying nozzle 7 to perform a wash in a concentrated manner while rotating, an operation of the second auxiliary path 8*b* may be programmed at a control unit. Since the dishware having greater depth such as a pot, a rice bowl, or a soup bowl is frequently used in South Korea, while the dish washer performs a washing of the dishware, the second auxiliary path 8*b* is rotated at a certain angle, and the dishware may be sequentially washed in a concentrated manner by the wash water being sprayed from the auxiliary spraying nozzle 7. The auxiliary spraying nozzle 7 may move back and forth a certain section to wash dishware in a concentrated manner.

The second path 8*b* may be directly moved by a user. A user, in a case when a dishware having severe degree of contamination is present in the dishware basket 5, by rotating the second auxiliary path 8*b*, may be able to have the auxiliary spraying nozzle 7 spray the wash water in a concentrated manner at the dishware having severe degree of contamination.

The second auxiliary path 8*b* may be provided in a way to be moved relative to the first auxiliary path 8*a*, so that the position of the auxiliary spraying nozzle 7 may be varied. At this time, the second auxiliary path 8*b* may be provided with a locking structure such that the second auxiliary path 8*b* moves to a desired position and then fixed to the position. At least one portion of the second auxiliary path 8*b* may be provided to be extended from the first auxiliary path 8*a* while being inserted into the first auxiliary path 8*a*. At an inner wall of the first auxiliary path 8*a*, a plurality of protrusions are formed, and a locking unit may be formed at an outer wall of the second auxiliary path 8*b* so as to be interfered by the protrusions. The plurality of protrusions may be formed in a moving direction of the locking unit of when the second auxiliary path 8*b* is extended. As a user extends the second auxiliary path 8*b* as much as desired, the locking unit is engaged with the protrusion, so that the second auxiliary path 8*b* may be fixed. The first auxiliary path 8*a* may be provided in the shape of a curve. At least one portion of the second auxiliary path 8*b* inserted into the first auxiliary path 8*a* may be provided to correspond to the shape of the first auxiliary path 8*a*. The first auxiliary path 8*a* and the second auxiliary path 8*b* may be provided in a way to form the shape of a curve, such as a semicircle.

As the above, a user, by varying the position of the auxiliary spraying nozzle 7, may wash dishware having severe degree of contamination in a concentrated manner, and thus washing efficiency may be able to be increased. The auxiliary spraying nozzle 7 may be provided in plurality. In the case when the auxiliary path 7 is provided in pluralities, at least one of auxiliary paths 7 may be provided to wash dishware, which is placed at a particular position, in a concentrated manner, as the spraying position of the wash water is varied as the above.

As is apparent from the present disclosure, by washing the dishware having severe degree of contamination in a concentrated manner through an auxiliary spraying nozzle, the dishware may be washed cleanly. In addition, the position of the auxiliary spraying nozzle may be varied by a user, thereby contributing to the convenience in the setting of a concentrated wash zone.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. A dish washer, comprising: a body having a washing tub;

a door configured to open and close one surface of the body; a plurality of dishware baskets positioned inside the washing tub; a single sump unit positioned inside the washing tub and configured to accommodate and supply wash water, the single sump unit having: a first path unit, and a second path unit from which a first dividing path unit and a second dividing path unit are branched;

a plurality of main spraying nozzles configured to:

receive the wash water through the first path unit and the second dividing path unit, and spray the wash water to the plurality of dishware baskets;

an auxiliary spraying nozzle configured to:

receive the wash water through the first dividing path unit, and spray the wash water to the plurality of dishware baskets;

a connecting path configured to connect the first path unit and the second dividing path unit to the main spraying nozzle;

an auxiliary path configured to connect the first dividing path unit to the auxiliary spraying nozzle, wherein one of the plurality of main spraying nozzles and the auxiliary spraying nozzle are to spray the wash water upward to the plurality of dishware baskets, the auxiliary spraying nozzle is disposed below the plurality of main spraying nozzles, a spraying position of the wash water to be sprayed by the auxiliary spraying nozzle is varied by rotation of the auxiliary path which is to rotate around a vertical axis, and the auxiliary path includes a first auxiliary path and a second auxiliary path, and the second auxiliary path is rotatably connected to the first auxiliary path.

2. The dish washer of claim 1, wherein:

the second auxiliary path communicates with the first auxiliary path.

3. The dish washer of claim 2, wherein:

the second auxiliary path is connected to the first auxiliary path by a connecting unit that is foldable or unfoldable.

4. The dish washer of claim 1, wherein:

the second auxiliary path is rotatable in both directions by the motor.

5. The dish washer of claim 1, wherein:

a manipulation unit is positioned at the body, and the second auxiliary path is rotated through a manipulation of the manipulation unit.

6. The dishwasher of claim 5, wherein:

the manipulation unit includes a plurality of buttons or dials, and the second auxiliary path is configured to be rotated in a predetermined rotating direction or at a predetermined rotating angle according to the manipulation of the manipulation unit.

7. The dish washer of claim 1. wherein:

the second auxiliary path is rotated while dishware is being washed, so that the wash water being sprayed by the auxiliary spraying nozzle washes the dishware positioned inside the washing tub in a concentrated manner.

8. The dish washer of claim 1, wherein:

a valve configured to open/close the connecting path or the auxiliary path is positioned at the sump unit.

9. A dish washer, comprising: a body having a washing tub;

a door configured to open and close one surface of the body;

a plurality of dishware baskets positioned inside the washing tub and including an upper dishware basket and a lower dishware basket;

a single sump unit positioned inside the washing tub and configured to accommodate and supply wash water, the single sump unit having:

a first path unit, and a second path unit from which a first dividing path unit and a second dividing path unit are branched;

a plurality of main spraying nozzles configured to:

receive the wash water through the first path unit and the second dividing path unit, and spray the wash water to the plurality of dishware baskets; an auxiliary spraying nozzle configured to:

receive the wash water through the first dividing path unit, and spray the wash water to the plurality of dishware baskets; a connecting path configured to connect the first path unit and the second dividing path unit to the main spraying nozzle; and an auxiliary path configured to connect the first dividing path unit to the auxiliary spraying nozzle, wherein one of the plurality of main spraying nozzles and the auxiliary spraying nozzle are to spray the wash water upward to the plurality of dishware baskets, the auxiliary spraying nozzle disposed below the lower dishware basket, a spraying position of the wash water to be sprayed by the auxiliary spraying nozzle is varied by rotation of the auxiliary path which is to rotate around a vertical axis, and the auxiliary path includes a first auxiliary path and a second auxiliary path, and the second auxiliary path is rotatably connected to the first auxiliary path.

10. The dish washer of claim 9, wherein:

a portion of the second auxiliary path extends from the first auxiliary path while being inserted into the first auxiliary path.

11. The dish washer of claim 10, wherein:

a plurality of protrusions are formed at an inner side of the first auxiliary path, and the second auxiliary path is located at one side thereof with a locking unit interfering with the protrusions, so that the second auxiliary path is fixed as the locking unit interferes with the protrusion.

12. The dish washer of claim 11, wherein:

the plurality of protrusions are formed along a moving direction of the locking unit when the second auxiliary path is being extended.

13. The dish washer of claim 9, wherein:

the auxiliary spraying nozzle includes a plurality of auxiliary spraying nozzles, and at least one of the plurality of auxiliary spraying nozzles is varied in position.

* * * * *